United States Patent [19]

Tran

[11] 4,162,423

[45] Jul. 24, 1979

[54] LINEAR ACCELERATORS OF CHARGED PARTICLES

[75] Inventor: Duc T. Tran, Buc, France

[73] Assignee: C.G.R. MeV, Buc, France

[21] Appl. No.: 859,193

[22] Filed: Dec. 9, 1977

[30] Foreign Application Priority Data

Dec. 14, 1976 [FR] France ..... 76 37625

[51] Int. Cl.[2] ..... H01J 25/10

[52] U.S. Cl. ..... 315/5.41; 315/5.42; 333/125

[58] Field of Search ..... 315/5.41, 5.42; 333/9, 333/10

[56] References Cited

U.S. PATENT DOCUMENTS

| | | | |
|---|---|---|---|
| 2,813,996 | 11/1957 | Chodorow | 315/5.42 |
| 2,925,522 | 2/1960 | Kelliher | 315/5.42 |
| 3,133,227 | 5/1964 | Brown et al. | 315/5.42 |
| 3,333,142 | 7/1967 | Takeda et al. | 315/5.42 |
| 3,758,879 | 9/1973 | Beguin et al. | 333/10 |
| 4,024,426 | 5/1977 | Vaguine | 315/5.42 |
| 4,118,653 | 10/1978 | Vaguine | 315/5.41 |
| 4,122,373 | 10/1978 | Vaguine | 315/5.41 |

*Primary Examiner*—Saxfield Chatmon, Jr.
*Attorney, Agent, or Firm*—Cushman, Darby & Cushman

[57] ABSTRACT

A linear accelerator for generating a beam of charged particles accelerated within a wide energy range without modifying the microwave energy injected into the accelerator structure, this accelerator structure comprising a bunching section and an accelerating section respectively constituted by a plurality of resonant cavities, the cavities of the bunching section being electromagnetically coupled in such a manner that two adjacent cavities are phase-shifted of $\pi$ one with respect to the other, these bunching and accelerating sections being respectively supplied by a microwave generator delivering a microwave signal w divided, by means of a combined coupler and phase shifter, into two microwave signals $w_1$, $w_2$ respectively injected into the accelerating and bunching sections with predetermined amplitudes and phases.

7 Claims, 5 Drawing Figures

LINEAR ACCELERATORS OF CHARGED PARTICLES

BACKGROUND OF THE INVENTION

Linear accelerator for accelerating charged particles used in certain kinds of radiotherapy apparatus for medical treatments, must be as small as possible in size, in particular in the case where the accelerator is arranged in the mobile head of an irradiation unit. Moreover, it is advantageous that such a linear accelerator exhibits:

a wide energy range;

facility for modifying the adjustable energy;

a high efficiency.

It is an object of the present invention to obtain a linear accelerator having these characteristics.

OBJECT OF THE INVENTION

The object of the invention is to provide a linear accelerator for generating a beam of accelerated charged particles, the particle energy being able to vary within a wide energy range without modifying the microwave energy injected into the accelerator structure.

SUMMARY OF THE INVENTION

According to the the invention, a linear accelerator for accelerating charged particles, comprises a particle source, an accelerating structure including a bunching section and an accelerating section respectively constituted by a plurality of resonant cavities coupled to one another and equipped at their centre with an orifice to pass said particles, means for injecting a H.F. signal emitted by a high frequency generator within said accelerating structure, said injecting means comprising a combined coupler and phase-shifter system enables a microwave signal $w_1$ of given amplitude and phase to be injected into said accelerating section and simultaneously a microwave signal $w_2$ of given amplitude and phase to be injected into said bunching section, said two microwave signals $w_1$ and $w_2$ being obtained from the signal w issued from said H.F. generator, the cavities of said bunching section being electromagnetically coupled to one another in such a manner that two adjacent cavities are phase-shifted of $\pi$ one with respect to the other.

BRIEF DESCRIPTION OF THE DRAWING

For the better understanding of the invention and to show how the same may be carried into effect, reference will be made to the drawings accompanying the ensuing description in which.

SPECIFIC DESCRIPTION

Figure 1:
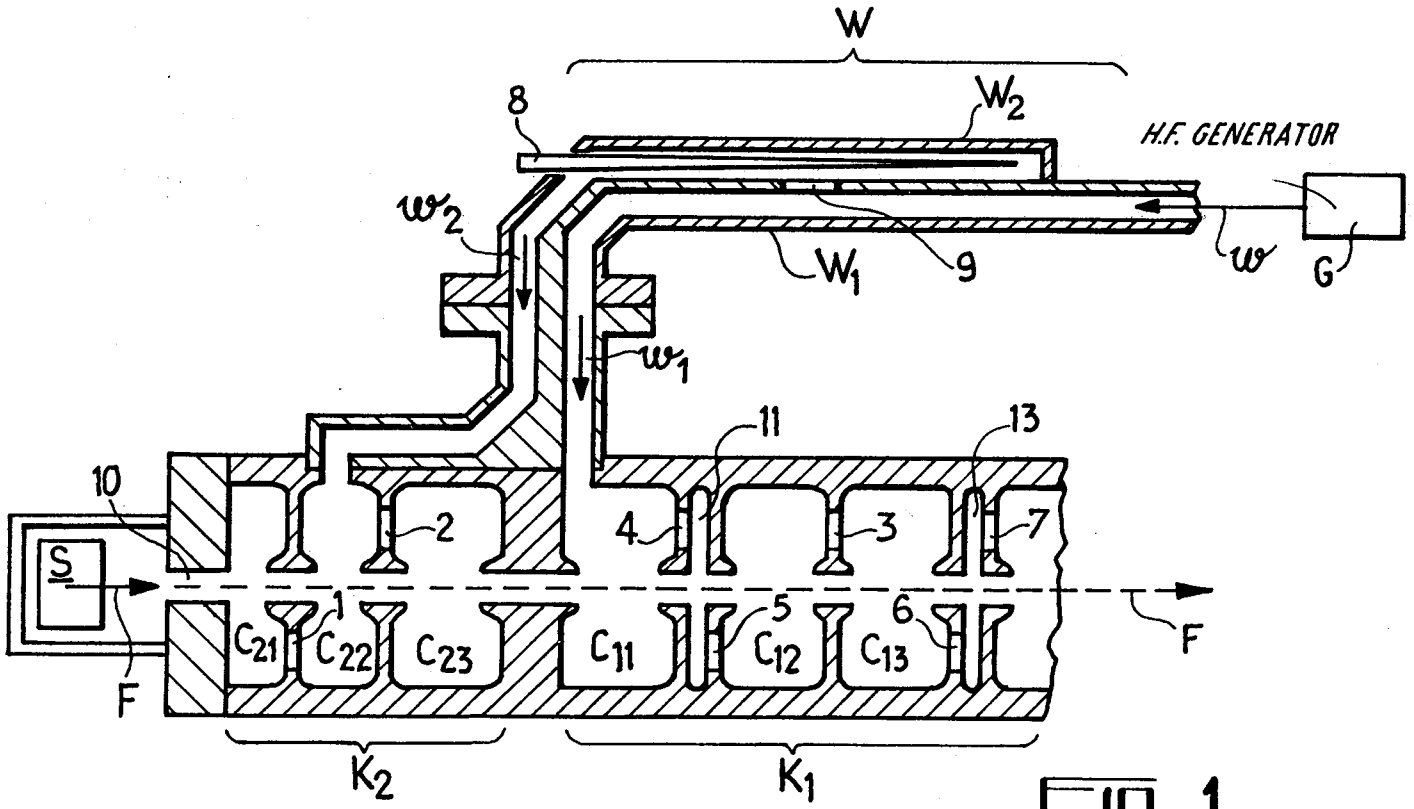
FIG. 1 illustrates in longitudinal section a linear accelerator equipped with a combined coupler and phase-shifter system in accordance with the invention.

FIG. 1 illustrates in longitudinal section an embodiment of a linear accelerator for accelerating charged particles, in accordance with the invention. This accelerator comprises a charged particle source S (electron source for example) and an accelerating structure comprising a bunching section $K_2$ and an accelerating section $K_1$. The bunching section $K_2$ is constituted by n resonant cavities (n is equal to 3 in the present example), cylindrical in shape, these cavities $C_{21}$, $C_{22}$, $C_{23}$ being electromecanically coupled to one another, by means of coupling holes 1 and 2 formed in their adjacent walls in such a manner that the phase-shift between two adjacent cavities is equal to $\pi$. The accelerating section $K_1$ is constituted by m accelerating cavities $C_{11}$, $C_{12}$, $C_{13}$ . . . coupled alternately to one another either by means of coupling cavities 11, 13 respectively equipped with coupling holes 4, 5, and 6, 7 or by means of coupling holes 3. In the embodiment shown in FIG. 1, the accelerating section $K_1$ is a triperiodic structure of the kind described by the present Applicant in the U.S. Pat. No. 3,953,758. A hyperfrequency generator G furnishing a H.F. signal w of given frequency is coupled to the accelerating structure by means of a combined coupler and phase-shifter system W for simultaneously injecting into the bunching section $K_2$ a microwave signal $w_2$ of given amplitude and phase, and, into the accelerating section $K_1$, a microwave signal $w_1$ of given amplitude and phase. This combined coupler and phase-shifter system W comprises, in the example shown in FIG. 1:

a first waveguide $W_1$ having two extermities electromagnetically coupled to the microwave generator G and to one of the cavities of the accelerating section $K_1$ respectively;

and a second waveguide $W_2$ having two extremities electromagnetically coupled to the first waveguide $W_1$ by means of a coupling hole 9 and to one of the cavities in the bunching section $K_2$ respectively, this waveguide $W_2$ being equipped with phase-shifter means which, in the embodiment shown in FIG. 1, are represented by a plunger 8 of electrically insulating material (quartz for example), which can displace longitudinally in the waveguide $W_2$.

In operation, the signal $w_1$ which is the major part of the microwave signal w produced by the generator G is injected into the accelerating section $K_1$ whilst the signal $w_2$ which is only a small fraction of this signal w is injected into the bunching section $K_2$. The electron beam F issued from the particle source S penetrates the bunching section $K_2$ through an axial orifice 10 and, under the effect of the H.F. electric field created in the bunching cavities $C_{21}$, $C_{22}$, $C_{23}$ by the signal $w_2$, the electrons are grouped into bunches before entering the accelerating section $K_1$. The plunger 8 inserted into the waveguide $W_2$ enables the bunches of electrons formed into the bunching cavities to arrive at the centre of the first cavity $C_{11}$ of the accelerating section $K_1$ with a given phase-shift in relation to the maximum of the H.F. electric field prevailing in the first cavity $C_{11}$. Thus, the phase-shifter, which is adjustable, allows to modify the phase of the microwave signal $w_2$ injected into the bunching section $K_2$ and consequently to modify the energy of the electrons which exit from the linear accelerator, within a wide range, since the bunches of electrons which arrive at the centre of the cavity $C_{11}$ when the electric field is at a maximum, will be accelerated to their maximum energy, whilst bunches of electrons which arrive at the centre of the cavity $C_{11}$ when the electric H.F. field is zero, will not be accelerated (minimum electron energy at the exit of the accelerator). Between these two borderline cases, it is thus possible, at the output of the linear accelerator, to obtain electrons of desired energy, while the H.F. signals $w_2$ and $w_1$ respectively injected into the bunching and accelerating sections $K_2$ and $K_1$ respectively keep the same amplitudes.

Figure 2:
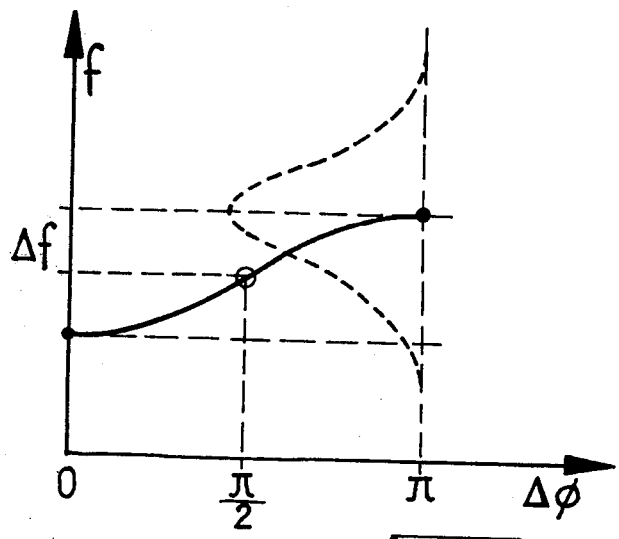
FIG. 2 and FIGS. 3A-3C, respectively, illustrate the modes of operation of a three-cavity bunching section and the distribution of the H.F. electric field in these cavities.
Figure 3:
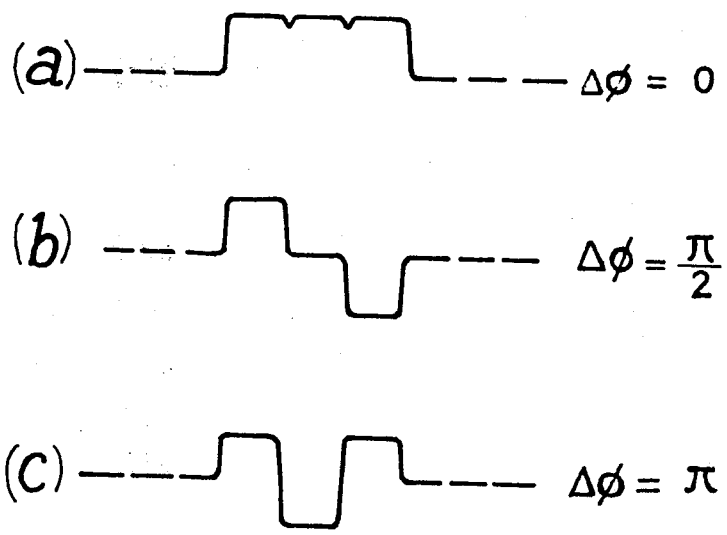

The accelerating structure shown in FIG. 1 operates in a standing wave mode and the adjacent cavities $C_{11}$, $C_{12}$, $C_{13}$... of the accelerating section $K_1$ have a phase-shift of $2\pi/3$ (triperiodic structure) between them. The adjacent cavities $C_{21}$, $C_{22}$, $C_{23}$ of the bunching section $K_2$ have a phase-shift of $\pi$ between one another. This phase-shift $\pi$ offers the following advantages. In fact, there are three possible fundamental modes of operation of the bunching section $K_2$ corresponding respectively to phase-shifts of zero, $\pi/2$ and $\pi$ between the adjacent cavities $C_{21}$, $C_{22}$ and $C_{23}$, as FIG. 2 shows. The distributions of the H.F. electric field corresponding to these three modes, have respectively been shown in FIGS. 3(*a*), 3(*b*) and 3(*c*). If the dimensions of the cavities $C_{21}$, $C_{22}$, $C_{23}$ are suitably chosen, the bunching section $K_2$ can operate on the $\pi$-mode, which is the most efficient mode of operation of this section. If the waveguide $W_2$ is coupled to the bunching section $K_2$ by the central cavity $C_{22}$, it is pointed out that the mode $\pi/2$ (which is closest to the $\pi$ operating mode), is never excited since, as FIG. 3(*b*) shows, this $\pi/2$ mode corresponds to a H.F. electric field distribution such that the H.F. field has to be zero in the central cavity $C_{22}$. This kind of coupling therefore allows to prevent any influencing of the operation of the accelerator by the $\pi/2$ mode.

Some changes could be made in the above embodiment without departing from the scope of the invention, particularly the number of cavities in the bunching section $K_2$ may be greater than three and also, the accelerating section $K_1$ may be other than a triperiodic structure (for example it may be a biperiodic structure corresponding to a phase-shift of $\pi/2$ between two adjacent cavities). Moreover, the accelerating section $K_1$ can also be chosen in such a way that it operates in the travelling wave mode whilst the bunching section $K_2$ operates in the standing wave mode, the combined coupler and phase-shifter system W being identical to that described earlier. In this case, the efficiency of the accelerator is slightly lower but it is less sensitive to frequency variations. The result is that the frequency matching is only required between the bunching section $K_2$ and the generator G, whereas in the case of an accelerator operating in the standing wave mode, frequency matching has to be effected between the generator G and the accelerating section $K_1$, the bunching section $K_2$ being less sensitive to the frequency variations of the accelerating cavities (due to a rise in their temperature for example).

Thus, the particle accelerator in accordance with the invention makes it possible to produce accelerated particles whose energy can be adjustable within a wide range (from 2 MeV to some tens of MeV for example) simply by modifying the phase of the H.F. signal $w_2$ injected into the bunching section $K_2$, this signal $w_2$ being a low-power signal. Such an accelerator has a good efficiency.

What I claim is:

1. A linear accelerator for accelerating charged particles comprising:

a particle source;

an accelerating structure including a bunching section and an accelerating section, each respectively constituted by a plurality of resonant cavities electromagnetically coupled to one another and provided, at their center with an orifice to pass said particles;

means for injecting a microwave signal emitted by a microwave generator into said accelerating structure, said injecting means comprising a combined coupler and phase-shifter system which enables a microwave signal $w_1$ of determined amplitude and phase to be injected into said accelerating section and, simultaneously, a microwave signal $w_2$ of determined amplitude and to be injected into said bunching section, said two microwave signals $w_1$ and $w_2$ being obtained from a signal w issued from said microwave generator; said cavities of said bunching section being determined and electromechanically coupled to one another in such a manner that two adjacent cavities are phase-shifted by $\pi$, one with respect to the other.

2. A linear accelerator as claimed in claim 1, wherein said microwave source is a high frequency generator and said combined coupler and phase-shifter system comprises:

a first waveguide having two extremities electromagnetically coupled to said high frequency generator and to one of the cavities of the accelerating section, respectively; and a second waveguide electromagnetically coupled to the first waveguide by means of a coupling hole and to one of the cavities of the bunching section, said second waveguide being equipped with phase-shifter means.

3. A linear accelerator as claimed in claim 2, wherein said phase-shifter means comprise a plunger made of electrically insulating material.

4. A linear accelerator as claimed in claim 2, wherein said bunching section comprises three resonant cavities coupled to one another by means of coupling holes, said second waveguide being coupled to the intermediate cavity of said bunching section.

5. A linear accelerator as claimed in claim 1, wherein said accelerating section is a standing wave structure of a biperiodic type.

6. A linear accelerator as claimed in claim 1, wherein said accelerating structure is a standing wave structure of a triperiodic type.

7. A linear accelerator as claimed in claim 1, wherein said accelerating structure is travelling wave structure.

* * * * *